United States Patent [19]

Penton et al.

[11] 4,040,194

[45] Aug. 9, 1977

[54] CHANGEABLE MESSAGE SIGN CONSTRUCTION

[76] Inventors: Hugh V. Penton, 850 Winthrop Road, San Marino, Calif. 91108; Gerald P. Dunphy, 1232 Laster Ave., Anaheim, Calif. 92803; Clayton O. Stevens, 12626 Ocaso Ave., La Mirada, Calif. 90368

[21] Appl. No.: 709,286

[22] Filed: July 28, 1976

[51] Int. Cl.[2] ..... G09F 7/04

[52] U.S. Cl. ..... 40/142 A

[58] Field of Search ..... 40/63 R, 142 A, 140, 40/125

[56] References Cited

U.S. PATENT DOCUMENTS

| | | | |
|---|---|---|---|
| 2,879,614 | 3/1959 | Baldanza | 40/140 X |
| 3,210,080 | 10/1965 | Rael et al. | 40/142 A X |
| 3,339,301 | 9/1967 | Doris et al. | 40/63 R X |
| 3,456,373 | 7/1969 | Epton | 40/142 A X |
| 3,496,665 | 2/1970 | Goldman | 40/63 R X |
| 3,965,599 | 6/1976 | Ebner | 40/63 R X |

*Primary Examiner*—Russell R. Kinsey
*Assistant Examiner*—Wenceslao J. Contreras
*Attorney, Agent, or Firm*—Mahoney, Schick & Cislo

[57] ABSTRACT

Face sheets preferably formed of thin sheet aluminium are spaced apart with at least one having a horizontally recessed message pocket preferably debossed therein. A magnet, preferably magnetic tape, is mounted at the interior face of the message pocket selectively removably retaining a message plate preferably of steel positioned in the message pocket by magnetic force. The space between the face sheets is preferably foam filled with the foam covering the magnet.

16 Claims, 5 Drawing Figures

CHANGEABLE MESSAGE SIGN CONSTRUCTION

BACKGROUND OF THE INVENTION

This invention relates to a changeable message sign construction and more particularly, to such a sign construction making use of a magnet or magnets for selectively removeably retaining message plates in recessed pockets thereof. Unique features incorporated in the sign construction make fabrication and provision of the same at a relatively low cost while still providing a changeable message sign construction which is efficiently operable for a long period of useful life even under the more severe outdoor weather conditions.

Many varying forms of changeable message sign constructions have heretofore been provided and are particularly useful by merchants for advertising both the type and price of their various products. Signs of this character have met with increasing demand in the more recent years due to the rapid fluctuations in our modern economy. For instance, with increasing competition, varying shortages as well as frequent over stocking, and frequent varying price schedules, it has become almost a requirement in modern merchandising to display the types and prices of at least certain of the items available for sale. One area of particular interest for changeable message signs is in the merchandising of automotive fuel, not so much as to the types of fuel since these are of a relatively standardised nature, but primarily as to the particular daily price thereof which may fluctuate quite rapidly.

In the case of display of fuel prices, particularly gasoline, usually three grades are involved and normally a minimum of two. The pricing of the various fuel grades is usually stepped in several cent gradients. Furthermore, each particular grade price is comprised of three numerals, the third numeral designating tenths of a cent and being separated from the other two numerals by a decimal point. Thus, each gaoline pricing sign is made up of a minimum of six and more frequently nine numeral designations all of which must be frequently changeable in order to properly reflect the frequent fluctuations.

Although previously, when gasoline prices were more stable, it was not so important that a gasoline service station display its gasoline prices on a large display board or sign, but this has changed radically more recently. For instance, with the recent severe rise in gasoline prices and the rapid fluctuations thereof even at these high prices, there are many city and state ordinances which require a large pricing display readily discernible from a distance. In addition, for competitive purposes, many gasoline service stations have gone to multiple large pricing displays. This means, therefore, that each instance of gasoline price fluctuation requires that the various numerals of the pricing signs be changed, keeping in mind that a raising or lowering of the price of one grade of gasoline will normally occasion similar raising or lowering of all two or three grades of gasoline. The overall result is virtually the absolute requirement of conveniently usable changeable message signs.

Most prior changeable message sign constructions have either been of a relatively low priced, but quite difficult of changeable message use or quite complex and expensive with over convenience in changeable message use. In the lower priced type, message or numeral plates are normally slid vertically downwardly into a receiving display receptacle and even the slight damage to such receptacles or the slight collection of dirt or debris therein can make the changing of the price plates quite difficult. In the more expensive pricing signs, various complicated structural elements are involved and the overall cost of the same becomes quite prohibitive, particularly where great numbers of the same are desirable for an individual gasoline service station.

OBJECTS AND SUMMARY OF THE INVENTION

It is, therefore, an object of this invention to provide a changeable message sign construction which is quite economical to fabricate and provide, yet includes unique changeable message structure efficiently operable with maximum convenience of use over a long period of useful life. One of the major provisions of the present invention is the formation of the changeable message sign construction of spaced face sheets with at least one of the face sheets having one or more recessed message pockets formed therein for the selective reception and ready replacement of message plates to create the sign changeable message display. Furthermore, the selected message plates are selectively removably retained in a particular message pocket during sign message display by magnetic means, such magnetic means being positioned internally of the sign at the internal surface of the face sheet and transmitting magnetic forces through the message pocket to magnetic attractable means on the message plate. Thus, the message plates are retained in the particular message pocket merely by positioning the same therein and are readily removable and replaceable without difficulty during the message changing operation.

In the optimum form of the changeable message sign construction of the present invention, a face sheet having the message pocket or pockets formed therein may be constructed substantially totally of a magnetic force transmitting sheet metal, such as aluminium sheet, and may have the message pocket or pockets debossed in the exterior surface thereof providing overall economical fabrication. The message plates may be formed substantially totally of a magnetically attractable sheet metal, such as a ferrous sheet metal, likewise providing economics to the overall fabrication. In the case where a double sided changeable message sign is desired, both face sheets may be similarly formed to provide the economic features.

Also in the optimum form of the changeable message sign construction of the present invention, both face sheets, whether both including the changeable message feature or not, may be formed of the sheet metal and the internal sign space therebetween may have a foam filling installed therein which completely covers and protects the functional magnetic means at the internal sides of the face sheet message pockets. In this manner, not only is a very economically efficient sign construction provided which has adequate strength and minimum weight, but one which will withstand inclement weather conditions in outdoor use over a long period of useful life. Furthermore, with the magnetic means internally of the face sheets likewise covered and protected by the foam filling, such magnetic means is fully protected from atmospheric deterioration which could cause a premature failure of the overall structure.

Other objects and advantages of the invention will be apparent from the following specification and the accompanying drawings which are for the purpose of illustration only.

DESCRIPTION OF THE BEST EMBODIMENT CONTEMPLATED

Figure 1:
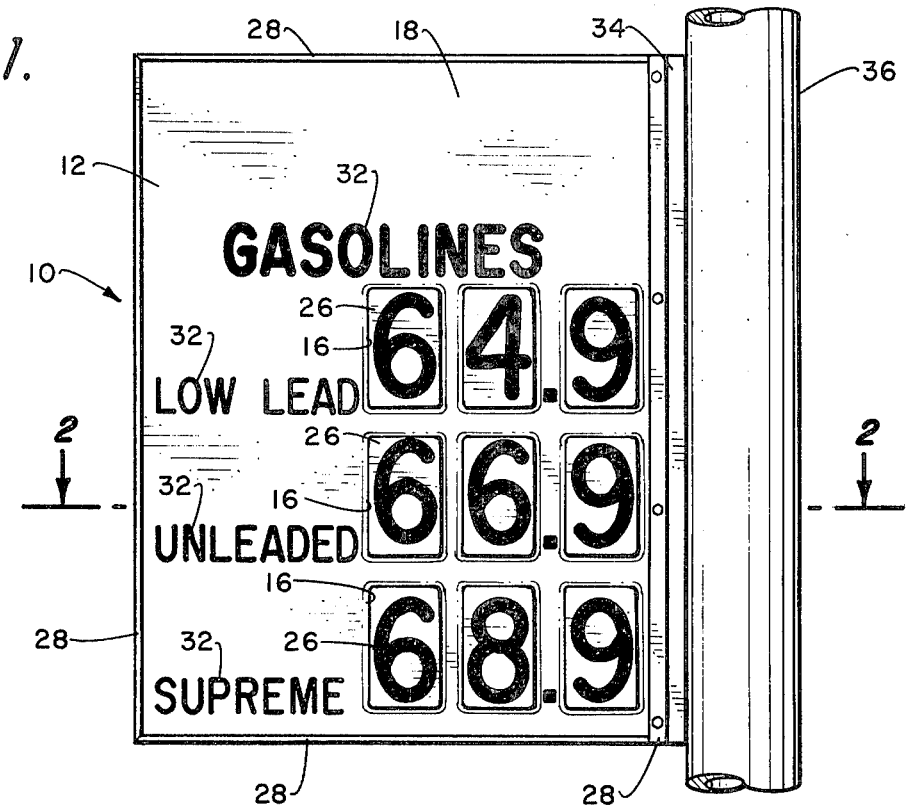
FIG. 1 is a fragmentary, front elevational view of an automotive service station sign incorporating a preferred embodiment of the changeable message sign construction of the present invention.

Referring to the drawings, a preferred embodiment of the changeable message sign construction of the present invention is illustrated incorporated in an automotive service station gasoline price sign generally indicated at 10, the sign including generally vertically extending and generally horizontally spaced, first and second face sheets 12 and 14. The first and second face sheets 12 and 14 are preferably each formed substantially totally of a magnetic force transmitting sheet metal, preferably thin aluminium in the order of about three to four one hundredths of an inch, and in the particular sign form shown, each has three vertically spaced rows of three horizontally spaced and aligned, horizontally recessed message pockets 16 debossed in the exterior faces 18 thereof. The process of "debossing" is well known to those skilled in the art and generally involves the press formation of a recessed configuration integrally in metal such as the sheet metal of the first and second face sheets 12 and 14. Furthermore, although debossing is the preferred form for providing the message pockets 16 in the first and second face sheets 12 and 14, certain of the principles of the present invention could be satisfied by formation of these message pockets in usually multi-piece, sheet metal fabrication form, but in any event, horizontally recessed portion 20 of the message pockets must include at least some magnetic force transmitting material or metal for purposes of the present invention as will be hereinafter apparent.

Magnetic means, preferably permanent magnets formed by strips of magnetic tape 22 are mounted at interior faces 24 of the first and second face sheets 12 and 14 at each of the message pockets 16, the strips of magnetic tape preferably being normally adhered to the horizontally recessed portions 20 of the message pockets as shown. The formation of the permanent magnets by magnetic tape 22 is again well known to those skilled in the art, such magnetic tape being readily available in the industrial supply market-place. As an example, one satisfactory form thereof which will serve as permanent magnets so as to not require an exterior electrical supply is of rubber bonded barium ferrite composite materials manufactured in sheets and strips and having the magnetic properties thereof generated by ferromagnetic barium ferrite crystals and possesses an unusually strong resistance to demagnetisation. These strips of magnetic tape 22 will, therefore, be effective to transmit magnetic forces from the interior faces 24 through the horizontally recessed portions 20 of the message pockets 16 and exteriorly thereof.

Figure 5:
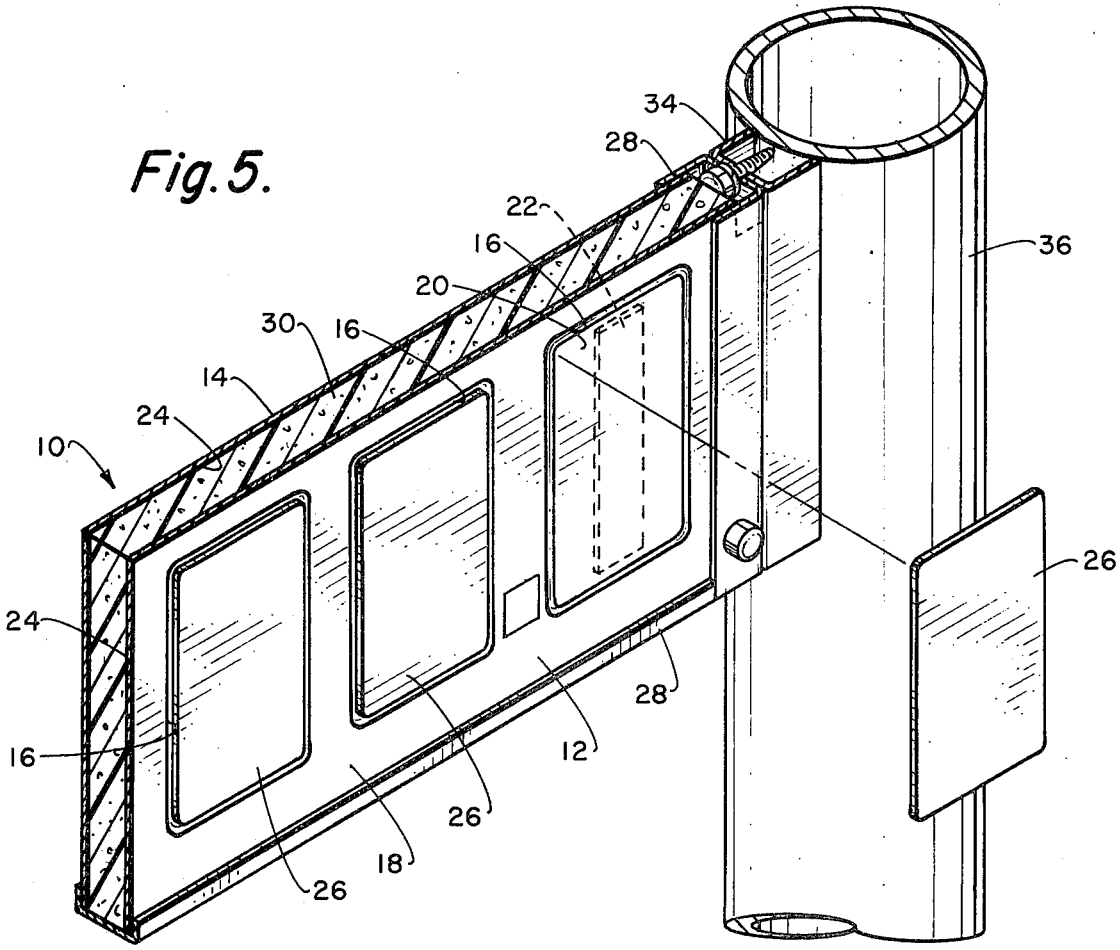
FIG. 5 is an enlarged, perspective view, part in section, of the embodiment of sign construction of FIG. 1 illustrating the message changing operation thereof.
Figure 2:
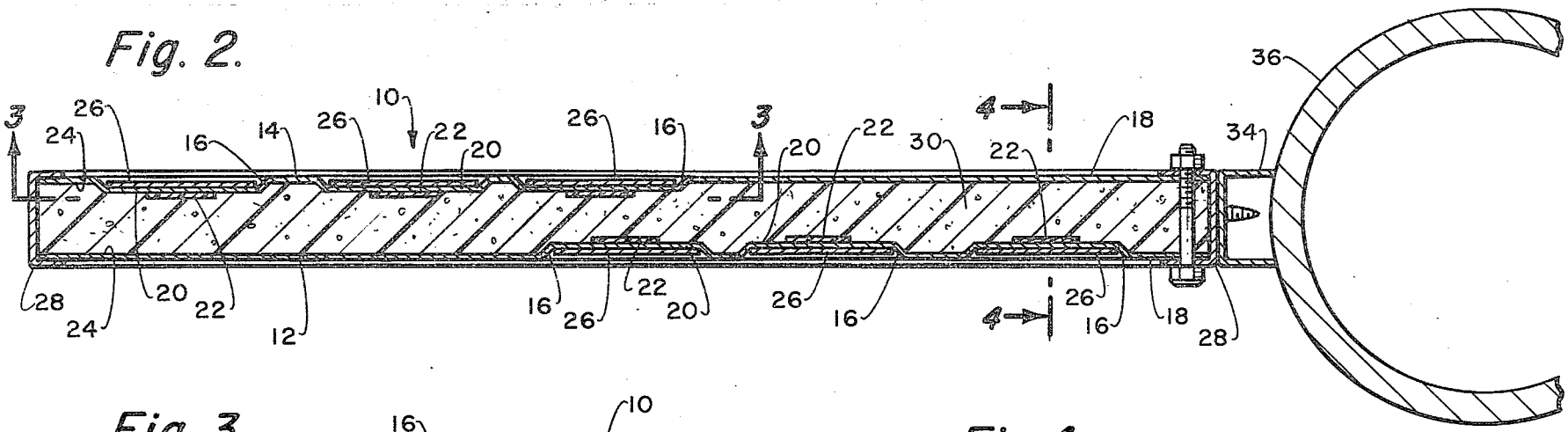
FIG. 2 is an enlarged, fragmentary, horizontal sectional view looking in the direction of the arrows 2—2 in FIG. 1.
Figure 4:
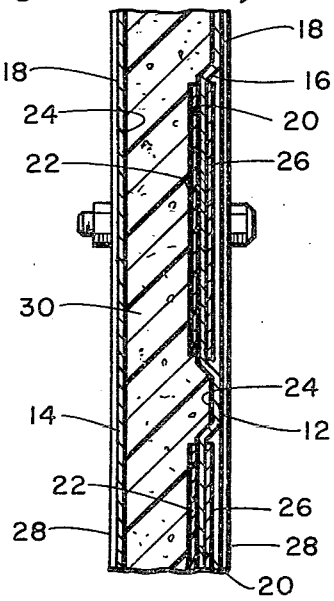
FIG. 4 is a fragmentary, vertical sectional view looking in the direction of the arrows 4—4 in FIG. 2.
Figure 3:
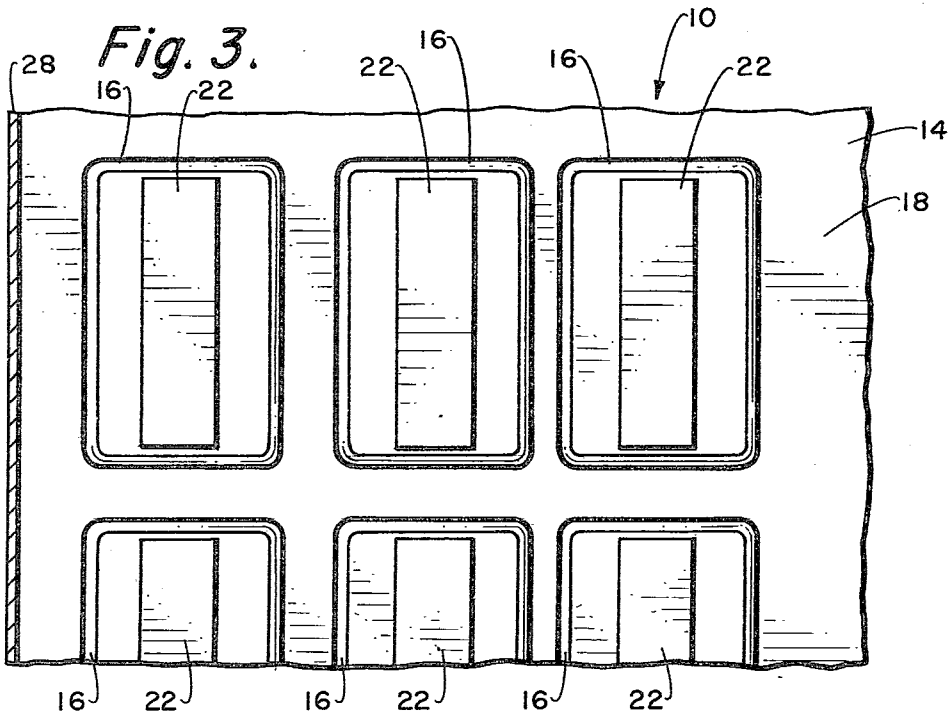
FIG. 3 is a fragmentary, vertical sectional view looking in the direction of the arrows 3—3 in FIG. 2.

To complete the essentials of the changeable message portion of the sign 10, selectively positionable and selectively removable message plates 26 are provided for each of the message pockets 16, the message plates being required to be formed at least partially of a magnetically attractable material, preferably each substantially totally of a ferrous sheet metal such as steel. The message plates 26 are preferably of a size corresponding to the dimensions of the message pockets 16 so as to selectively inter-fit therein with only slight clearance for convenience in positioning. Furthermore, it is preferred that the thickness of the message plates 26 will be less than the recessed depths of the message pockets 16 so that the message plates will fully recess horizontally within the exterior faces 18 of the first and second face sheets 12 and 14. With the magnetic tape 22 transmitting magnetic forces through the horizontally recessed portions 20 of the message pockets 16, the message plates 26 will be retained in the message pockets once so positioned by the magnetic forces generated and will remain so positioned until selectively removed as particularly shown in FIGS. 2 and 5.

To complete the overall construcion of the sign 10, usual metal side, top and bottom edge caps 28 are secured in place in usual manner, and more important to the present invention, during such installation, the sign 10 is preferably totally internally filled horizontally between the first and second face sheets 12 and 14 with a plastic foam material 30 also simultaneously covering and isolating the magnets formed by the magnetic tape 22. The plastic foam material may be of any usual well known form which is non-moisture absorbent. Thus, not only are the important internal magnets in the form of the magnetic tape 22 covered and protected from deterioration by isolation from exterior elements, as are the first and second face sheets 12 and 14 as to the interior faces 24 thereof, but the first and second face sheets are further strengthened in the overall assembly of the sign 10 by such foam 30.

With the sign 10 in this instance being an automotive service station gasoline sign, various usual wording 32 may be painted or otherwise applied to the exterior faces 18 of the first and second face sheets 12 and 14 as illustrated in FIG. 1. Furthermore, the message plates 26 will be price numeral plates and each have the appropriate numerals painted or otherwise formed on at least one of the faces thereof. The various external metal surfaces of the sign 10 may be finished in any appropriate manner commensurate with the climatic conditions to which the sign will be subjected during a long period of useful life.

As illustrated herein, the sign 10 is side mounted by a usual mounting bracket 34 to a usual sign post 36. However, various other well known sign mounting may be used and does not enter into the principles of the present invention. In addition, other than specifically pointed out in the foregoing, the sign 10 may be fabricated in the usual manner using usual sign manufacturing procedures.

Although the unique changeable message sign principles of the present invention have been illustrated herein as incorporated in an automotive service station pricing sign, it is not intended to thereby limit the principles to this type of sign alone. For instance, there are many well known applications of pricing signs to many other merchandising functions and the principles of the present invention are just as readily applicable thereto. Still further, in various merchandising fields, there are many occasions where it is desired to rather than display pricing, to display word messages alone, yet such word messages are required to be of a readily changeable nature. All of these variations are fully contemplated within the scope of the present invention.

According to the principles of the present invention, therefore, a changeable message sign construction is presented incorporating an easily usable and quite efficient changeable message structure, yet a sign fabricated to include the same may be provided at a relatively low cost and will be usable over a relatively long period of useful life. In fabricating the first and second face sheets 12 and 14, the message pockets 16 are, in the optimum form merely debossed in such face sheets to minimise the compoications of fabrication procedure and eliminate otherwise expensive assembly costs. Furthermore, the message plates 26 are selectively positionable in and retained in the message pockets 16 solely by magnetic forces so that they are adapted for the most simplistic form of changing and replacement in carrying out the message changing procedures. Finally, and again in the preferred optimum forms, the magnetic forces at the message pockets 16 are provided by permanent magnets of magnetic tape 22 quickly applied adhering to interior surfaces of the sign 10 and the entire interior of the sign is foam filled during assembly to not only interiorly cover and fully protect the functioning interior magnets and the internal sign surfaces, but also adding strength to the first and second face sheets 12 and 14 so that these major components may be fabricated from simple, relatively thin, sheet metal in an economical manner.

We claim:

1. In a changeable message sign construction, the combination of: generally horizontally spaced and generally vertically extending first and second face sheets, at least said first face sheet being formed of a magnetic force transmitting sheet metal and having a horizontally recessed message pocket debossed in an exterior face thereof; a magnet operably mounted on an interior face of said first face sheet positioned magnetically effective through said first face sheet within the confines of said message pocket and transmitting magnetic forces exteriorly through said pocket; a message plate formed at least partially of a magnetically attractable material selectively removably positioned at least partially recessed within said message pocket of said first face sheet retained against at least generally horizontal displacement therefrom by said magnetic forces of said magnet.

2. In a changeable message sign construction as defined in claim 1 in which said message plate is formed substantially totally of a magnetically attractable sheet metal and is selectively removably positioned at least partially recessed within said message pocket of said first face sheet.

3. In a changeable message sign construction as defined in claim 1 in which said magnet is magnetic tape adhered to an interior face of said first face sheet at and interiorly of said message pocket.

4. In a changeable message sign construction as defined in claim 1 in which said second face sheet is formed of a magnetic force transmitting sheet metal similar to said first face sheet and has another of said debossed message pocket, said magnet and said message plate similar to said first face sheet.

5. In a changeable message sign construction as defined in claim 1 in which said second face sheet is formed of sheet metal; and in which space between said first and second face sheets is substantially filled with a relatively light filler material, interiorly between said face sheets, said filler material interiorly covering said magnet.

6. In a changeable message sign construction as defined in claim 1 in which said magnet is magnetic tape adhered to an interior face of said first face sheet at and interiorly of said message pocket; and in which said message plate is formed substantially totally of magnetically attractable sheet metal and is selectively removably positioned at least partially recessed within said message pocket of said first face sheet.

7. In a changeable message sign construction as defined in claim 1 in which said magnet is magnetic tape adhered to an interior face of said first face sheet at and interiorly of said message pocket; in which said message plate is formed substantially totally of magnetically attractable sheet metal and is selectively removably positioned at least partially recessed within said message pocket of said first face sheet; in which said second face sheet is formed of sheet metal; and in which space between said first and second face sheets is substantially filled with a foam material and the like interiorly between said face sheets, said foam material interiorly covering said first face sheet magnetic tape magnet.

8. In a changeable message sign construction as defined in claim 1 in which said magnet is magnetic tape adhered to an interior face of said first face sheet at and interiorly of said message pocket; in which said message plate is formed substantially totally of magnetically attractable sheet metal and is selectively removably positioned at least partially recessed within said message pocket of said first face sheet; in which said second face sheet is formed of a magnetic force transmitting sheet metal similar to said first face sheet and has another of said debossed message pocket, said magnet of magnetic tape and said metal message plate similar to said first face sheet; and in which said space between said first and second face sheets is substantially filled with a relatively light filler material interiorly between said face sheets, said filler material interiorly covering said magnetic tape magnets of said first and second face sheets.

9. In a changeable message sign construction as defined in claim 1 in which each of said first and second face sheets is formed of a magnetic force transmitting sheet metal such as aluminum; in which said message plate is formed substantially totally of a ferrous metal and is selectively removably positioned at least partially recessed within said message pocket of said first face sheet; in which said magnet is magnetic tape adhered to an interior face of said first face sheet at and interiorly of said message pocket; and in which space between said first and second face sheets is substantially filled with a relatively light filler material interiorly between said face sheets, said filler material interiorly covering said first face sheet magnetic tape magnet.

10. In a changeable message sign construction, the combination of: generally horizontally spaced and generally vertically extending first and second face sheets, at least said first face sheet having a horizontally recessed message pocket formed therein with a recessed surface formed at least partially of a magnetic force transmitting material; a magnet operably mounted on an interior face of said first face sheet positioned magnetically effective through said first face sheet at said message pocket and transmitting magnetic forces exteriorly through said magnetic force transmitting material of said pocket recessed surface; a message plate formed at least partially of a magnetically attractable material selectively removably positioned at least partially recessed within said message pocket of said first face sheet retained against at least generally horizontal displacement therefrom by said magnetic forces of said magnet; a relatively light filler material substantially filling interior space between said first and second face sheets and interiorly covering said magnet.

11. In a changeable message sign construction as defined in claim 10 in which said message pocket of said first face sheet has said recessed surface formed substantially totally of sheet metal; and in which said magnet is magnetic tape adhered to an interior face of said first face sheet at and interiorly of said message pocket.

12. In a changeable message sign construction as defined in claim 10 in which said message plate is formed substantially totally of a magnetically attractable sheet metal and is selectively removably positioned at least partially recessed within said message pocket of said first face sheet.

13. In a changeable message sign construction as defined in claim 10 in which said first and second face sheets are each formed substantially totally of relatively thin sheet metal.

14. In a changeable message sign construction as defined in claim 10 in which said first and second face sheets are each formed substantially totally of a relatively thin magnetic force transmitting sheet metal such as aluminum; and in which said message plate is formed substantially totally of a relatively thin magnetically attractable sheet metal such as ferrous metal.

15. In a changeable message sign construction as defined in claim 10 in which said first and second face sheets are formed substantially totally of a relatively thin magnetic force transmitting sheet metal such as aluminum; in which said magnet is a magnetic tape adhered to an interior face of said first face sheet at and interiorly of said message pocket; and in which said message plate is formed substantially totally of a relatively thin magnetically attractable sheet metal such as ferrous metal.

16. In a changeable message sign construction as defined in claim 10 in which said filler material interiorly between said face sheets is a foam material and the like.

* * * * *